US006102731A

United States Patent [19]

Daoud

[11] Patent Number: 6,102,731

[45] Date of Patent: Aug. 15, 2000

[54] CONNECTOR SECURITY MECHANISM

[75] Inventor: Bassel H. Daoud, Parsippany, N.J.

[73] Assignee: Lucent Technologies Inc., Murray Hill, N.J.

[21] Appl. No.: 09/218,063

[22] Filed: Dec. 21, 1998

[51] Int. Cl.[7] ..... H01R 4/24; H01R 4/26; H01R 11/20

[52] U.S. Cl. ..... 439/409

[58] Field of Search ..... 439/409, 410, 439/411, 412, 413, 417

[56] References Cited

U.S. PATENT DOCUMENTS

| | | | |
|---|---|---|---|
| 3,611,264 | 10/1971 | Ellis . | |
| 4,463,999 | 8/1984 | Knickerbocker | 439/371 |
| 4,662,699 | 5/1987 | Vachhani et al. . | |
| 4,793,823 | 12/1988 | Cozzens et al. . | |
| 5,240,432 | 8/1993 | Daoud . | |
| 5,453,022 | 9/1995 | Staiger | 439/413 |
| 5,637,011 | 6/1997 | Meyerhoefer et al. . | |
| 5,681,182 | 10/1997 | Reichle | 439/417 |
| 5,860,829 | 1/1999 | Hower et al. . | |

OTHER PUBLICATIONS

Technical Data Sheet of A.C. Egerton Limited, related to mini Rocker Cross Connection Cabinets (Nov. 1995).

*Primary Examiner*—Lincoln Donovan
*Assistant Examiner*—Javaid Nasri
*Attorney, Agent, or Firm*—Stroock & Stroock & Lavan LLP

[57] ABSTRACT

A tool-less insulation displacement connector comprising a top section and a bottom section, the top section being movable between an open position and a closed position; a latch member movable between an engaged position and a disengaged position, the latch member maintaining the top section in the closed position when the latch member is in the engaged position; and a releasable security member for preventing the latch member from moving between the engaged position and the disengaged position.

19 Claims, 5 Drawing Sheets

CONNECTOR SECURITY MECHANISM

FIELD OF THE INVENTION

This invention relates to a wiring connector, and in particular, to a connector having a security mechanism.

BACKGROUND OF INVENTION

In a telephone network, a network cable from the central office is connected to a building entrance protector (BEP) located at the customer site, where the individual telephone lines are broken out line by line. The network cable, which consist of a plurality of tip-ring wire pairs that each represent a telephone line, is typically connected to a connector block that is an integral part of the BEP. Such connectors may be, for example, the ubiquitous 66-type punch down connector, or an SC 99 type connector block, such as are available from Lucent Technologies Inc., or the mini-rocker tool-less insulation displacement (IDC) type connector, such as for example those sold by A. C. Egerton, Ltd. Other connectors used for telephony wiring applications are described in U.S. Pat. No. 4,662,699 to Vachhani et al., dated May 5, 1987, and in U.S. Pat. No. 3,611,264 to Ellis, dated Oct. 5, 1971.

A mini-rocker connector generally has a movable top section which comprises two generally tapered, funnel-shaped wire insertion holes and a lower fixed section which houses a pair of terminal strips. The terminal strips have a wire engaging portion at one end for engaging and making electrical contact with a wire. The terminal strips are generally parallel to one another but offset to provide a sufficient dielectric strength between them. In order to make the connector as small as possible, as a matter of design choice, the terminal strips are moved as close together as possible while maintaining good dielectric strength.

The top movable section of the connector pivots about a fixed axis located towards the back side of the connector. The top section has a movable latch member to maintain the top section in its closed position. To open the top section, a user releases the latch member and pivots the top section to its open position. When the top section is open, the terminal strips do not intersect the wire insertion holes, and when the top section is closed, the terminal strips intersect the wire insertion holes. In order to establish an electrical connection between the wires and the terminal strips a user first opens the top section, i.e., pivots the top section to its open position, inserts the pair of wires, and then closes the top section. Upon closing the top section of the connector, the wires are forced through the terminal strip engaging portion to make electrical and mechanical contact with the terminal strips. To remove the wires and/or break the electrical connection, the process is reversed.

The prior art connector has no security mechanism to prevent or hinder unauthorized opening of the connector top section. That is, once one has access to the connectors, i.e., by gaining access to the inside of the BEP or other utility box or area where such connectors are located, the connectors could be opened and the wires removed or otherwise reconfigured. Also, because there is no security mechanism on the prior art connectors, an authorized user may simply inadvertently open up a connector with out even knowing it. The present invention is directed at overcoming shortcomings of the prior art connectors.

SUMMARY OF THE INVENTION

Generally speaking, in accordance the instant invention, a connector security mechanism is provided which hinders unauthorized opening of a connector and minimizes accidental opening of connectors.

In a preferred embodiment, the connector generally has a top section, movable between an open position and a closed position, and a bottom fixed section. The top movable section generally pivots about a fixed axis. The top section has a latch member movable between an engaged position and a disengaged position. When the top section is in its closed position and the latch member is in its engaged position, the latch engages a corresponding retention member on the bottom section of the connector. Thus, when the top section is in its closed position and the latch member is in its engaged position the latch member maintains the top section in its closed position.

The connector of the present invention is constructed so as to accept a security member which prevents the latch member from being moved between its engaged and disengaged positions, thus preventing the latch member from being released and thereby maintaining the top section in its closed position. In order to release the latch member and open the top section of the connector, a user must first remove or otherwise disable the security member. When so constructed, the connector of the present invention both hinders unauthorized opening of the connector and inadvertent opening of the connector.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DESCRIPTION OF A PREFERRED EMBODIMENT

Generally speaking, in accordance the instant invention, a connector security mechanism is provided which hinders unauthorized opening of a connector and/or minimizes accidental opening of connectors.

Figure 1:
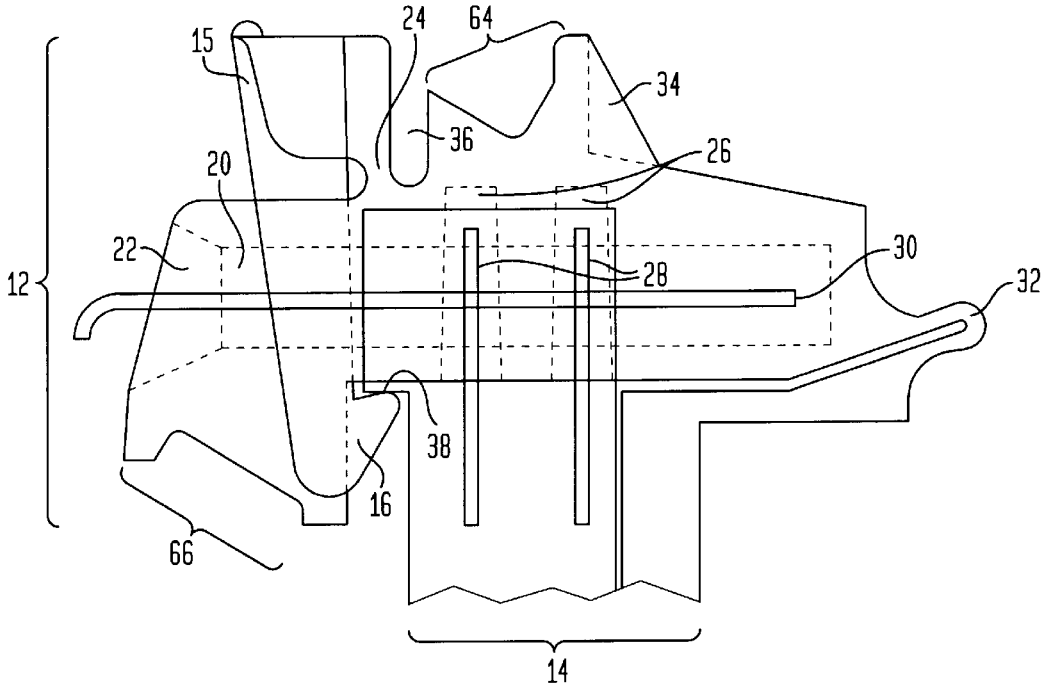
FIG. 1 is a side elevational view of a connector constructed in accordance with a preferred embodiment of the present invention with a security member removed.
Figure 2:
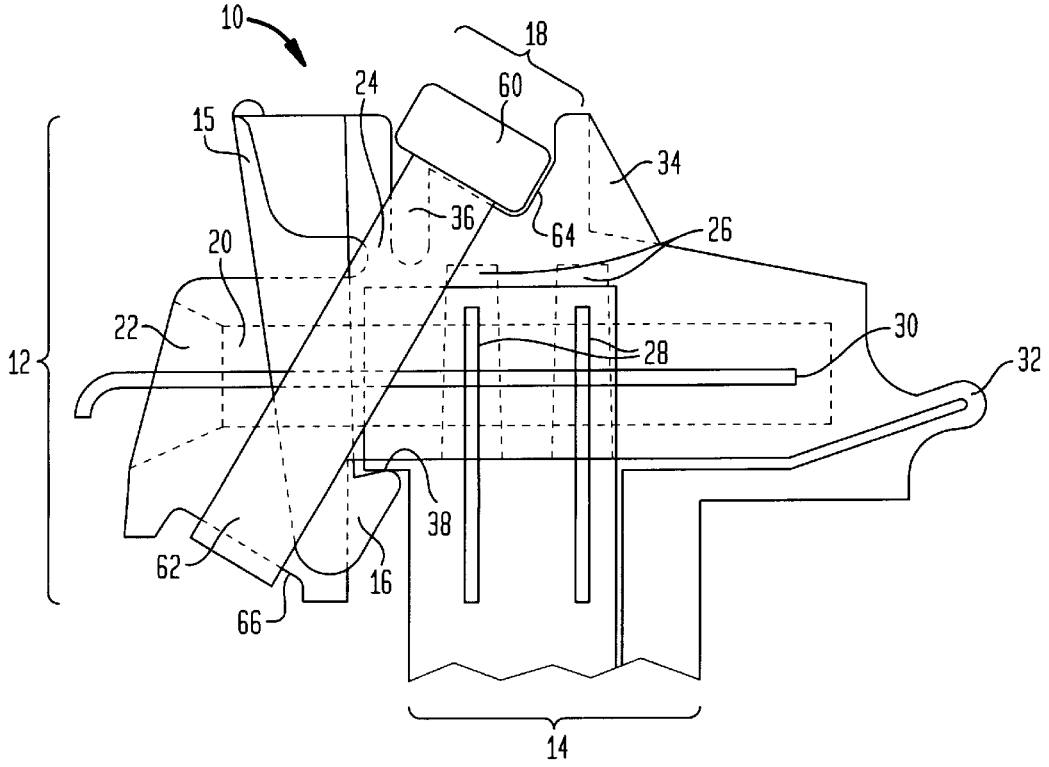
FIG. 2 is a side elevational view of the connector of FIG. 1 with the security member installed.

In a preferred embodiment, as seen in FIGS. 1 and 2, a connector of the present invention, generally indicated as 10, has a top section, generally indicated as 12, movable between an open position and a closed position, and a bottom fixed section, generally indicated as 14. Connector 10 generally comprises two entrance apertures 22 which lead to wire insertion holes 20. Wire insertion holes 20 are constructed so as to accept wires 30. Connector 10 also has terminal strip receiving portions 26, which are constructed to accept terminal strips 28 when the top section 12 is in its closed position.

Figure 3:
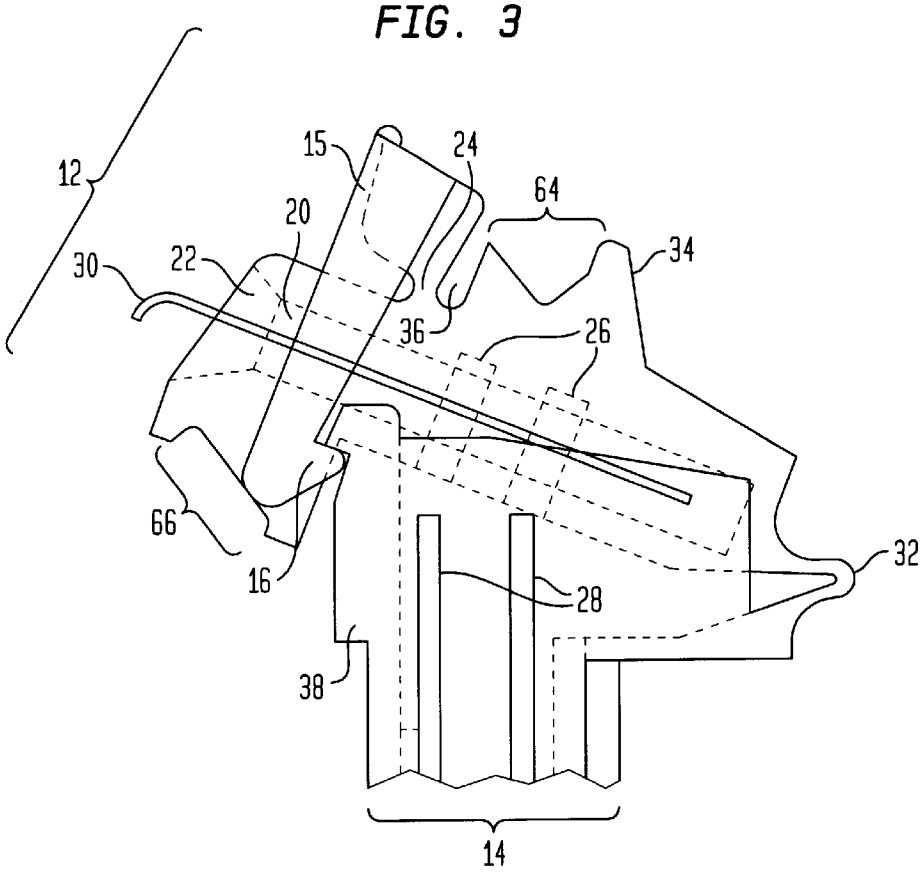
FIG. 3 is a side elevation view of the connector of FIG. 1 with the security member removed and the connector top section in its open position.

As seen in FIG. 3, when top section 12 is in its open position, terminal strips 28 do not intersect wire insertion holes 20, and when top section 12 is in its closed position (FIG. 2), terminal strips 28 intersect wire insertion holes 20. In order to establish an electrical and mechanical connection between the wires 30 and the terminal strips 28, a user first opens the top section 12, i.e., pivots top section 12 about fixed axis 32 to its open position, inserts pair of wires 30, and then closes the top section 12. Upon closing top section 12 of connector 10, wires 30 are brought into electrical and mechanical contact with terminal strips 28 in a manner known in the art. To remove the wires and/or break the electrical connection, the process is reversed.

As seen in FIG. 3, the top movable section 12 generally pivots about a hinged axis 32. The top section has a latch 15 movable between an engaged position and a disengaged position. As seen in FIGS. 1 and 2, when top section 12 is in its closed position and the latch 15 is in its engaged position, latch engaging portion 16 engages latch retaining portion 38 on the bottom section 14 of the connector 10. Thus, when the top section 12 is in its closed position and the latch is in its engaged position, the latch 15 maintains top section 12 in its closed position. In order to open top section 12, latch 15 must first be moved to its disengaged position.

To move latch 15 between its engaged position and its disengaged position, a user generally grips the connector between a finger grip portion 34 and top portion of the latch 15. Upon squeezing or other pressure, latch 15 pivots about living hinge 24 towards recess 36. Latch 15 is pivoted about living hinge 24 into recess 36 a sufficient distance so as to disengage latch engaging portion 16 from latch retaining portion 38. Once latch engaging portion 16 is disengaged from latch retaining portion 38, top section 12 is able to move to its open position.

The connector of the present invention is constructed so as to accept a security member 18 for preventing or hindering latch 15 from being moved between its engaged and disengaged positions, thus preventing latch engaging portion 16 from being released from latch retaining portion 38, and thereby maintaining top section 12 in its closed position. That is, security member 18 prevents latch 15 from pivoting about living hinge 24 into recess 36. In order to release latch 15 and open top section 12 of connector 10, a user must first remove or otherwise disable security member 18.

Figure 2A:
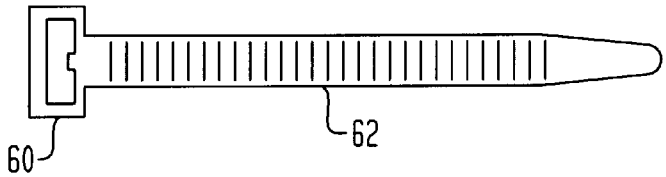
FIG. 2A is a front elevational view of a security member constructed in accordance with a preferred embodiment of the present invention, with the security member in an open position.
Figure 2B:
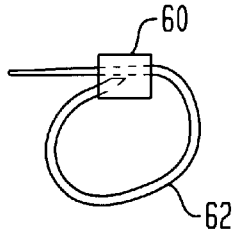
FIG. 2B is a side elevational view of the security member of FIG. 2B with the security member in a closed position.
Figure 2C:
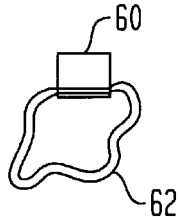
FIG. 2C is a front elevational view of a security member constructed in accordance with an alternate embodiment of the present invention.
Figure 2D:
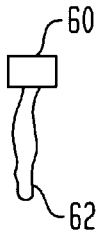
FIG. 2D is a side elevational view of the security member of FIG. 2C.

As seen in FIGS. 1 and 2, the connector 10 of the present invention is constructed to accept security member 18. In a preferred embodiment, as seen in FIG. 1, security member, generally indicated as 18, comprises an upper blade portion 60 which extends between a band portion 62 which generally wraps around top section 12. As seen in FIG. 2, top section 12 has a blade receiving portion 64 for accepting blade portion 60 at the upper side of top section 12, and a band receiving portion 66 for receiving band 62. Security member 18 preferably encircles top section 12 such that the blade portion 60 prevents latch 15 from pivoting about living hinge 24, thus preventing the top section from being moved into its open position. The security member 18 may be, for example, a plastic cable tie wrap of a type known in the art, with blade portion 60 being the latch housing of the tie wrap, as seen in FIGS. 2A and 2B. Security member 18 may also be an elastic or flexible band 62 with blade portion 60 attached, as seen in FIGS. 2C, 2D and 5A.

Figure 4:
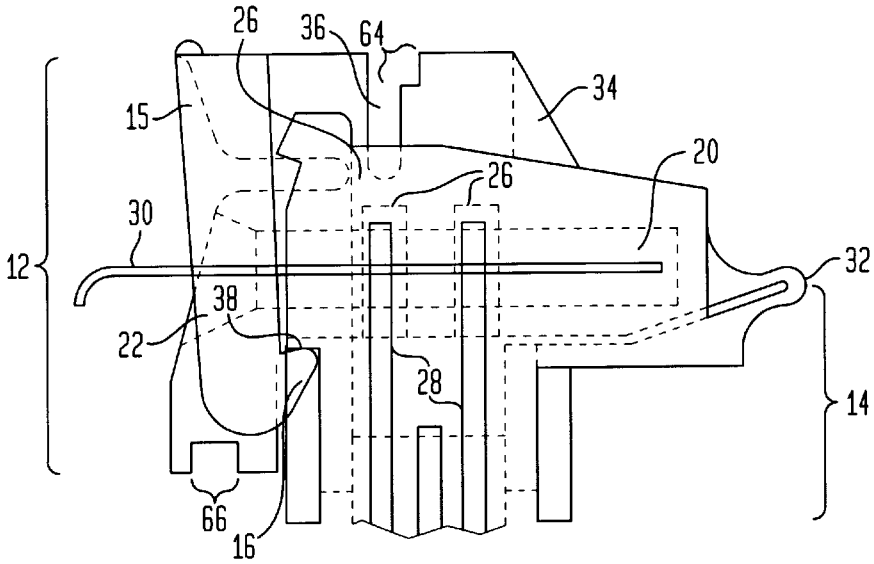
FIG. 4 is a side elevational view of a connector constructed in accordance with an alternate embodiment of the present invention with a security member removed.
Figure 5:
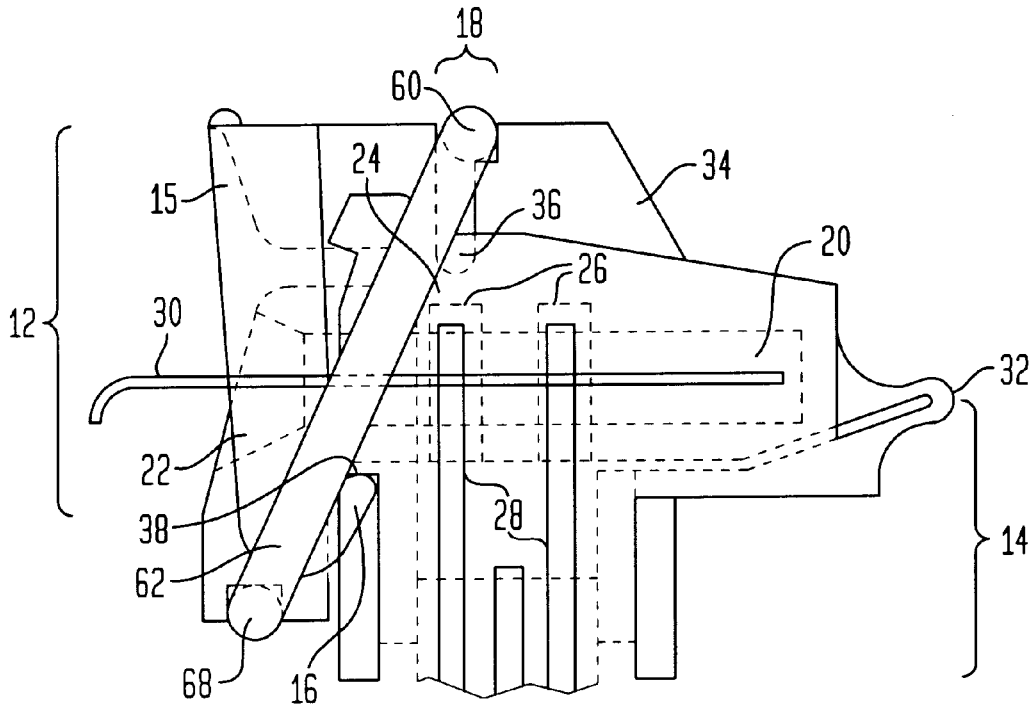
FIG. 5 is a side elevational view of the connector of FIG. 4 with the security member installed.
Figure 6:
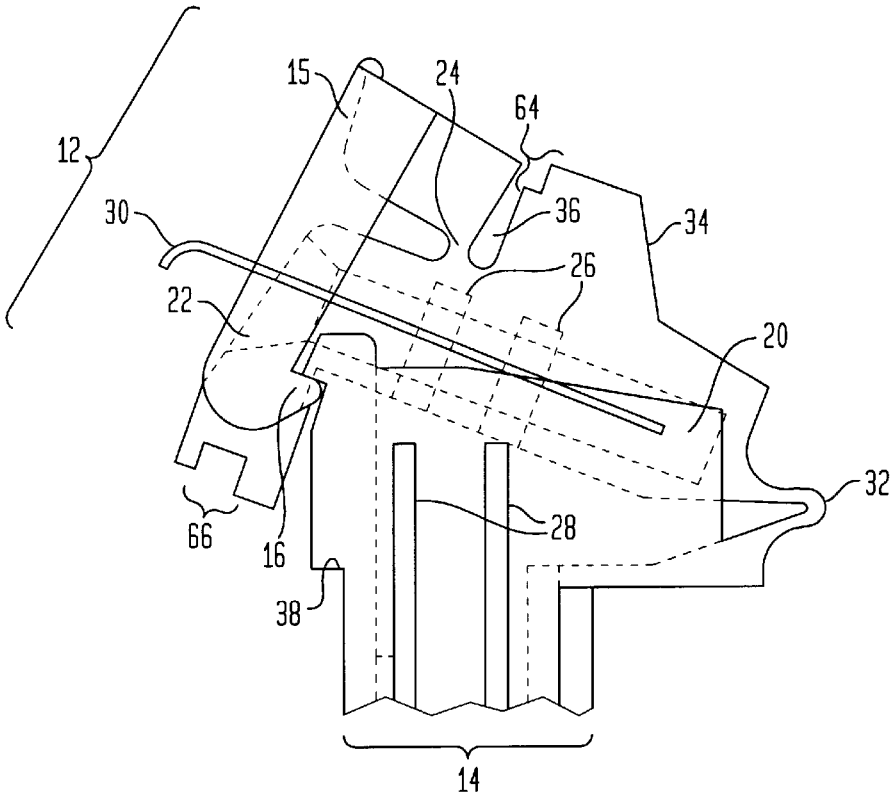
FIG. 6 is a side elevation view of the connector of FIG. 4 with the security member removed and the connector top section in its open position.

A connector 10 constructed in accordance with an alternate embodiment of the present invention is depicted in FIGS. 4–6. As seen in FIGS. 4–6, the security member 18 of the alternate embodiment is constructed somewhat differently, but accomplishes the same objective. That is, as seen in FIG. 5, when installed security member 18 prevents latch 15 from pivoting about living hinge 24 into recess 36. Thus, as in the preferred embodiment, in order to release latch 15 and open top section 12 of connector 10, a user must first remove or otherwise disable security member 18.

Figure 5A:
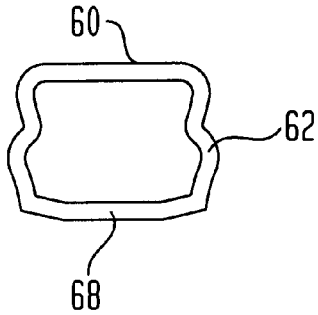
FIG. 5A is a front elevational view of the security member of FIG. 5.

As seen in FIGS. 4 and 5A, an alternate embodiment of the connector 10 of the present invention is constructed to accept an alternate security member 18. In this embodiment, security member, generally indicated as 18, comprises an upper blade portion 60 and a lower blade portion 68, with a band portion 62 extending between the upper blade 60 and lower blade 68 and which generally wraps around top section 12. Top section 12 has an upper blade receiving portion 64 for accepting blade portion 60 at the upper side of top section 12, and a lower blade receiving portion 66 for receiving lower blade 68. One of skill in the art will recognize that the upper blade portion 60 prevents latch 15 from pivoting about living hinge 24, thus preventing the top section from being moved into its open position.

Security member 18 is preferably made of a material that is easily released or otherwise disengaged by a user with the appropriate operating knowledge or an appropriate tool. Also, security member 18 is preferably not completely destroyed upon disablement, but is capable of being reconnected or reconstructed when the user is finished with the task at hand. Thus, when the connector is closed and the user or technician is finished, the security of the connector can be re-established by the technician. When so constructed, the connector of the present invention both hinders unauthorized opening of the connector and inadvertent opening of the connector. Security member 18 can also be cut and disposed of upon each release, as a matter of design choice.

A security member of the present invention could be made of any material, or constructed in any shape as a matter of design choice, without departing from the spirit of the invention. That is, security member 18 of the present invention is designed, constructed and positioned on connector 10, whether integral or separable with connector 10, so as to prevent and/or hinder the movement of latch 15. One of skill in the art will recognize that security member 18 could be made of, by way of a non-limiting example, plastic, metal, rubber, acrylic, wood, or the like, just to name a few. Also, one of skill in the art will recognize the positioning of security member 18 is merely a matter of design choice. That is, security member 18 could be positioned anywhere on connector 10 so as to perform the functions described herein without departing from the spirit of the invention. For example, security member 18 could be positioned entirely within recess 36, or constructed and positioned anywhere on connector 10 to prevent latch 15 from moving without departing from the spirit of the invention.

Figure 7:
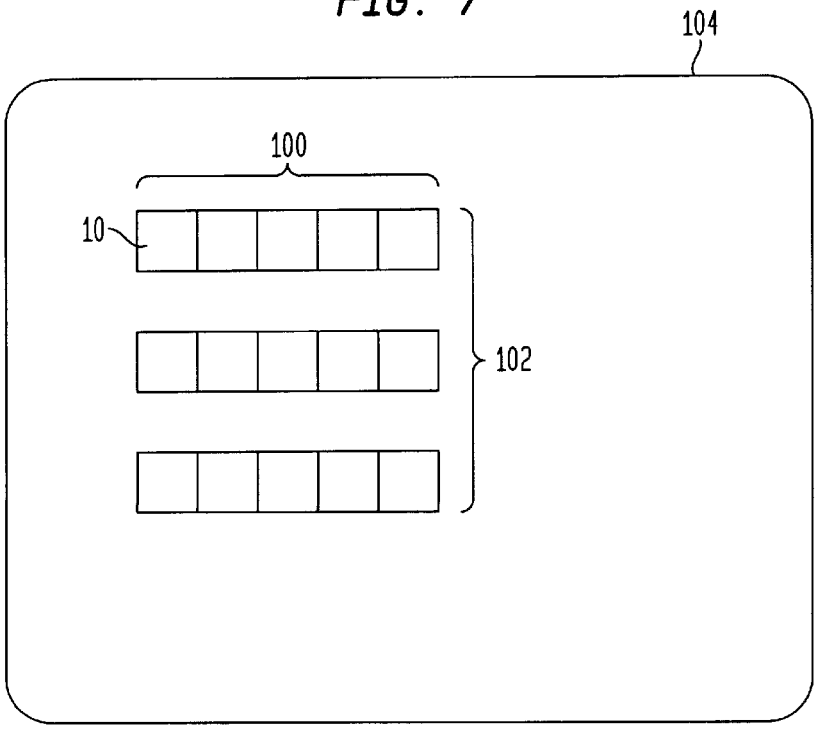
FIG. 7 is a front elevational view of a connector mounted as part of a connector block in a junction box.

As seen in FIG. 7, connector 10 may be mounted as part of a connector block, generally indicated as 100, as an array of connectors, generally indicated as 102. Further, array 102 may be mounted within a wiring junction box 104. Junction box 104 may be, by way of a non-limiting example, a building entrance protector or a network interface unit.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A tool-less insulation displacement connector comprising:

a top section having a wire insertion hole and a terminal strip receiving portion and a bottom section having a terminal strip, said top section being movable about a hinge between an open position and a closed position such that said terminal strip intersects said wire insertion hole when said top section is in said closed position;

a latch member movable between an engaged position and a disengaged position, said latch member maintaining said top section in said closed position when said latch member is in said engaged position; and a releasable security member for preventing said latch member from moving between said engaged position and said disengaged position.

2. The connector according to claim 1, wherein said security member forms part of either said top section or said bottom section.

3. The connector according to claim 1, wherein said security member is separate from said top section and said bottom section.

4. The connector according to claim 1, wherein said security member is constructed so as to be removable from said connector.

5. The connector according to claim 1, wherein said security member is re-attachable after being released.

6. The connector according to claim 1, wherein said security member is made of a material selected from a group of materials consisting of metal, acrylic, wood, rubber and fiberglass.

7. The connector according to claim 1, wherein said security member is made of plastic.

8. The connector according to claim 1, wherein said security member is made of a non-conductive material.

9. The connector according to claim 1, wherein said security member is a cable tie.

10. The connector according to claim 1, wherein said security member is made of a conductive material.

11. The connector according to claim 1, wherein said connector is mounted to a connector block as part of an array of connectors.

12. The connector according to claim 11, wherein said connector block is mounted within a wiring junction box.

13. The connector according to claim 12, wherein said junction box is a building entrance protector.

14. The connector according to claim 12, wherein said junction box is a network interface unit.

15. A tool-less insulation displacement connector comprising:

a top section having a wire insertion hole and a terminal strip receiving portion and a bottom section having a terminal strip, said top section being movable about a hinge between an open position and a closed position such that said terminal strip intersects said wire insertion hole when said top section is in said closed position;

a latch member movably attached to said top section and movable between an engaged position and a disengaged position;

said latch member maintaining said top section in said closed position when said latch member is in said engaged position;

said top section comprising a security member receiving portion for accepting a security member;

said security member comprising a blade portion and a band portion, said blade portion being positioned generally at said security member receiving portion and said band portion generally being wrapped around said top section; and said blade portion preventing said top section from moving between said closed position and said open position.

16. A tool-less insulation displacement connector comprising:

a top section having a wire insertion hole and a terminal strip receiving portion and a bottom section having a terminal strip, said top section being movable about a hinge between an open position and a closed position such that said terminal strip intersects said wire insertion hole when said top section is in said closed position;

a latch member movably attached to said top section and movable between an engaged position and a disengaged position;

said latch member maintaining said top section in said closed position when said latch member is in said engaged position;

a security member comprising an upper blade portion and a lower blade portion and a band portion extending between said upper blade portion and said lower blade portion;

said top section comprising an upper blade receiving portion and a lower blade receiving portion for accepting said upper blade portion and said lower blade portion;

at least said upper blade portion preventing said top section from moving between said closed position and said open position.

17. A tool-less insulation displacement connector comprising:

a top section having a wire insertion hole and a terminal strip receiving portion and a bottom section having a terminal strip, said top section being movable about a hinge between an open position and a closed position such that said terminal strip intersects said wire insertion hole when said top section is in said closed position;

a latch member movable between an engaged position and a disengaged position;

said latch member maintaining said top section in said closed position when said latch member is in said engaged position; and a security member for preventing said top section from moving between said closed position and said open position.

18. A method for securing a tool-less insulation displacement connector comprising the steps of:

(a) installing a releasable security member on an Insulation Displacement Connector, said security member being constructed and positioned so as to prevent a top section having a wire insertion hole and a terminal strip receiving portion of said connector from being opened about a hinge from a bottom section having a terminal strip.

19. A system for securing a tool-less insulation displacement connector comprising:

an insulation displacement connector, said connector comprising a top section having a wire insertion hole and a terminal strip receiving portion and a bottom section having a terminal strip, said top section being movable about a hinge between an open position and a closed position such that said terminal strip intersects said wire insertion hole when said top section is in said closed position;

a removable security member for preventing said top section from moving between said closed position and said open position.

* * * * *